US007789776B2

(12) United States Patent
Klein

(10) Patent No.: US 7,789,776 B2
(45) Date of Patent: Sep. 7, 2010

(54) GOLF TEE

(76) Inventor: Lon Klein, 111-09 76th Rd., Apt. C-5, 3rd Floor, Forest Hills, NY (US) 11375

( * ) Notice: Subject to any disclaimer, the term of this patent is extended or adjusted under 35 U.S.C. 154(b) by 333 days.

(21) Appl. No.: 11/697,902

(22) Filed: Apr. 9, 2007

(65) Prior Publication Data

US 2007/0238553 A1 Oct. 11, 2007

Related U.S. Application Data

(60) Provisional application No. 60/790,080, filed on Apr. 7, 2006.

(51) Int. Cl.
*A63B 57/00* (2006.01)

(52) U.S. Cl. ..... 473/387; 473/388; 473/390

(58) Field of Classification Search ..... 473/387–403, 473/316, 564; D21/717, 718
See application file for complete search history.

(56) References Cited

U.S. PATENT DOCUMENTS

| | | | | | |
|---|---|---|---|---|---|
| 1,239,356 | A * | 9/1917 | Cochrane | 473/322 |
| 1,522,544 | A * | 1/1925 | Pryde | 473/402 |
| 1,583,830 | A * | 5/1926 | Hicks | 473/388 |
| 1,588,815 | A * | 6/1926 | Sillcocks | 473/400 |
| 1,591,363 | A * | 7/1926 | Cowdery | 473/316 |
| 1,647,440 | A * | 11/1927 | Fish | 473/388 |
| 1,671,630 | A * | 5/1928 | Duganne | 473/395 |
| 1,730,046 | A * | 10/1929 | Stow | 473/391 |
| 2,011,203 | A * | 8/1935 | Kazuo | 473/396 |
| 2,153,260 | A * | 4/1939 | Edward | 473/389 |
| 2,455,705 | A * | 12/1948 | Seager | 473/402 |
| 2,747,768 | A * | 5/1956 | Raines | 473/391 |
| 3,220,727 | A * | 11/1965 | Legan | 473/386 |
| 3,954,263 | A * | 5/1976 | Whelan et al. | 473/399 |
| 4,783,077 | A * | 11/1988 | Lemon | 473/402 |
| 5,046,730 | A * | 9/1991 | Golden et al. | 473/399 |
| D326,129 | S * | 5/1992 | Hirschmann | D21/718 |
| 5,571,055 | A * | 11/1996 | Lewis et al. | 473/398 |
| 6,139,449 | A * | 10/2000 | Cardarelli | 473/387 |
| 7,008,335 | B2 * | 3/2006 | Kim | 473/391 |
| 7,108,618 | B2 * | 9/2006 | Frischmon et al. | 473/560 |
| 2006/0046866 | A1 * | 3/2006 | Rigoli | 473/316 |

* cited by examiner

*Primary Examiner*—Steven Wong
(74) *Attorney, Agent, or Firm*—Fay Kaplun & Marcin, LLP

(57) ABSTRACT

A golf tee with a body portion having a first end for inserting into the ground and a second end for supporting a golf ball when the first end is inserted in the ground, wherein the body portion is constructed of a biodegradable material. A golf tee insertion device having a base for supporting the device, a mandrel for holding a golf tee to be inserted into the ground and an actuator for moving the mandrel toward the ground so that the golf tee is inserted into the ground, wherein the actuator controls a depth of insertion of the tee.

4 Claims, 2 Drawing Sheets

GOLF TEE

PRIORITY CLAIM/INCORPORATION BY REFERENCE

This application claims priority to U.S. Provisional Application Ser. No. 60/790,080 entitled "Biodegradable Tee/Teeing Device" filed on Apr. 7, 2006, which is incorporated in its entirety herein.

BACKGROUND INFORMATION

Golfers are allowed to use a tee in the tee box to raise the golf ball off the ground. The tees are generally constructed from wood, but in the past two decades, some tees have been made of plastic. These wooden or plastic tees are usually left in the tee box after the golfer has hit the ball because the tee is broken, bent, is hit where the golfer cannot see the tee, etc. This leaving of the tee in and around the tee box produces litter and unsightly looking tee boxes. In addition, these used tees could cause environmental hazards if they are washed into streams or mistakenly eaten by animals. Furthermore, golf courses have expensive lawn mowers for grooming the grass to exacting specifications. These wooden or plastic tees may cause damage to the lawn mowers, thereby costing the golf course thousand of dollars in repairs.

SUMMARY OF INVENTION

A golf tee with a body portion having a first end for inserting into the ground and a second end for supporting a golf ball when the first end is inserted in the ground, wherein the body portion is constructed of a biodegradable material.

A golf tee insertion device having a base for supporting the device, a mandrel for holding a golf tee to be inserted into the ground and an actuator for moving the mandrel toward the ground so that the golf tee is inserted into the ground, wherein the actuator controls a depth of insertion of the tee.

A system comprising, a plurality of golf tees removably connected, each of the golf tees having a body portion having a first end for inserting into the ground and a second end for supporting a golf ball when the first end is inserted in the ground, wherein the body portion is constructed of a biodegradable material.

DETAILED DESCRIPTION

The present invention may be further understood with reference to the following description and the appended drawing. The exemplary embodiments of the present invention describe a golf tee as well as a device to insert the golf tee. The exemplary golf tee may be any of, or all of, disposable, biodegradable, and recyclable. Throughout this description, the tee is described as being made of a biodegradable material. However, it should be understood that the tee is not limited to being made of biodegradable material. That is, the material may also be disposable and/or recyclable.

Figure 1:
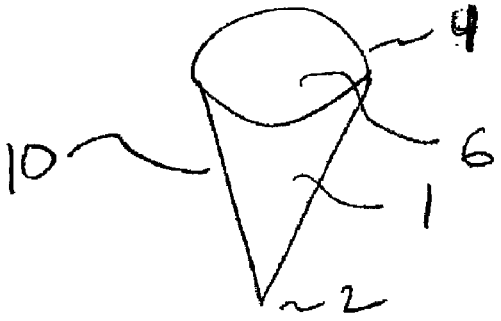
FIG. 1 shows a first exemplary golf tee according to the present invention.
Figure 2A:
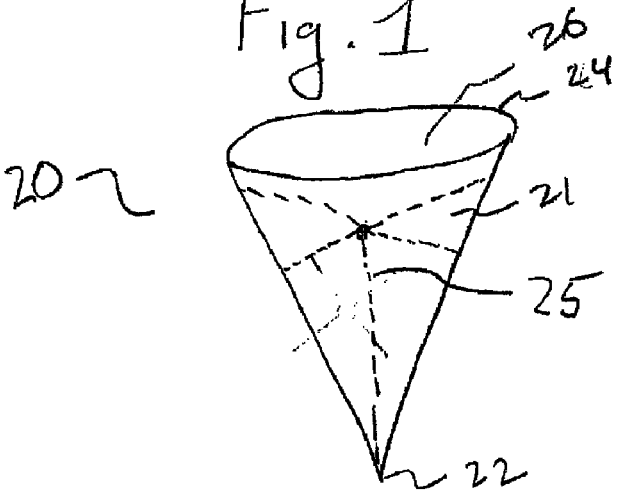
FIG. 2*a* shows a second exemplary golf tee according to the present invention.
Figure 2B:
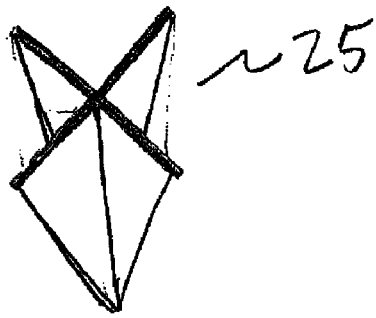
FIG. 2*b* shows an internal portion of the second exemplary golf tee of FIG. 2*a*.
Figure 3:
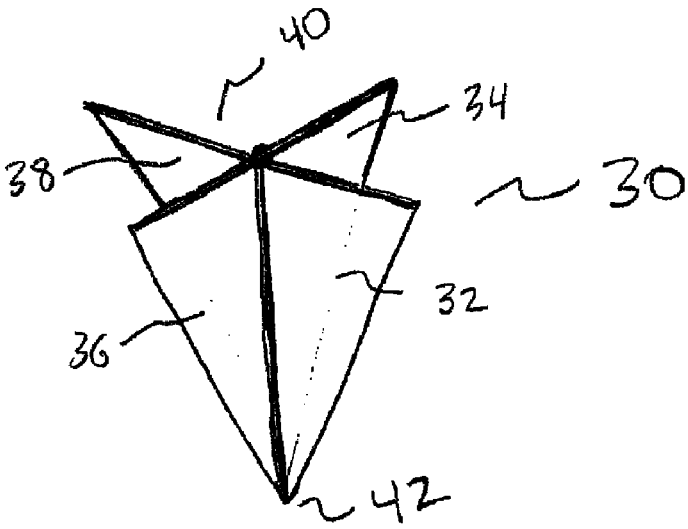
FIG. 3 shows a third exemplary golf tee according to the present invention.

FIGS. 1-3 show several exemplary embodiments of a tee according to the present invention. As described above, the golf tee of the present invention may be any of recyclable, biodegradable and/or disposable. That is, after the tee is placed into the ground and used a single time by the player, the tee may be left at the tee box to biodegrade into the soil, may be placed in a receptacle for disposal or may be collected for recycling. Since the tee is made of biodegradable materials, leaving the tee in the tee box after one use does not pose any environmental or physical hazard to persons or equipment used to maintain the tee box or the flora or fauna of the golf course or surrounding area. The tees may be packaged in any size pack, but a common pack may be in segments of 9 so that an average golfer may use two (2) packs per round of golf.

The tee may be made from any biodegradable material, for example, cellulose or a compressed cellulose composite with a binder, such as a paper sawdust with binder. The requirements for the biodegradable material for use in the tee is that it can be made so that it is rigid enough for insertion into the ground under various golfing conditions, that it can support a golf ball to be struck by any club, and that can maintain stability and support in the wind, rain, and other variable damp conditions.

FIG. 1 shows a first exemplary embodiment of a golf tee 10 that has an inverted cone shape. The inverted cone shape of the golf tee 10 is constructed of a body portion 1 of the biodegradable material creating a first pointed end 2, a second fluted end 4 and having a hollow center 6. The pointed end 2 is used as the insertion end. Those skilled in the art will understand that the pointed end 2 does is not required to be a sharp point, but may be rounded off. In another exemplary embodiment, the pointed end 2 may have the tip portion cut off forming a hole with a circular cross section at the pointed end 2. As will be described in more detail below, the golf tee 10 will be inserted using an insertion device that will have a corresponding design to allow the insertion device to insert the golf tee 10 into the ground. The fluted end 4 has a circular or near circular cross-section. The golf ball will be placed on the fluted end 4 after the tee 10 is inserted into the ground.

FIG. 2*a* shows a second exemplary embodiment of a golf tee 20 having the same general inverted cone shape as the golf tee 10. The inverted cone shape of the golf tee 20 is constructed of a body portion 21 of the biodegradable material creating a first pointed end 22, a second fluted end 24 and having a hollow center 26. The pointed end 22 is used as the insertion end and the fluted end 24 has a circular or near circular cross-section. The golf ball will be placed on the fluted end 24 after the tee 20 is inserted into the ground. However, the golf tee 20 also has an internal X-shaped structure 25 that is inside the hollow center 26 as shown by the dotted lines in FIG. 2*a*. The internal X-shape structure 25 is shown without the body portion 21 in FIG. 2*b*. The internal X-shape structure 25 is constructed of the same biodegradable material as the body portion 21 of the tee 20. The internal X-shape structure 25 may provide additional rigidity and support to the tee 20 and may also provide an additional manner of inserting the tee 20 into the ground as will be described in greater detail below.

In the exemplary embodiment of FIGS. 2*a*-*b*, the internal X-shape structure 25 extends from an area below the fluted end 24 to the pointed end 22 such that the ball will sit on the fluted end 24 without touching the X-shape structure 25. However, the X-shape structure 25 may be extended towards the fluted end 24 so that the ball may rest on the top of the X-shape structure 25, in addition to the fluted end 24.

The internal X-shape structure 25 may be made from the same unitary piece of biodegradable material as the body portion 21, i.e., the single piece of material may be folded during the manufacturing process to create the body portion 21 and the internal X-shape structure 25. However, it is also possible that the internal X-shape structure 25 is created from one or more separate piece(s) of biodegradable material and joined to the body portion 21 using, for example, a biodegradable glue.

FIG. 3 shows a third exemplary embodiment of a golf tee 30 that resembles the internal X-shape 25 of the tee 20. In this example, there is no conical shaped body portion. Rather, the tee 30 includes four triangular shaped blades 32-38. Each of the blades 32-38 tapers from a larger end 40 to a smaller end 42. Where the four blades 32-38 meet at the smaller end 42, the blades form a generally pointed end as with the above described tees. The smaller end 42 is the insertion end of the tee 30. Where the four blades 32-38 meet at the larger end 40, the blades 32-38 generally form an X-shape in cross-section. The X-shape cross-section of the larger end 40 is used for placing the golf ball when the tee 30 is inserted into the ground.

While not shown in FIG. 3, the blades 32-38 may intersect at a generally circular center portion that runs from the larger end 40 to the smaller end 42. The blades 32-38 may be constructed from any biodegradable material in the same manner as the other tees 10 and 20. The blades 32-38 may be constructed from a unitary piece of the biodegradable material by, for example, folding the material, or may be constructed from two or more pieces of the material that are fastened together.

Those skilled in the art will understand that the description of the tee 30 is generally the same as the description of the internal X-shape 25 of the tee 20. Thus, any of the construction details of either may be modified in corresponding manners. In one exemplary modification, the number of blades may vary. For example, the tee 30 may have more (e.g., six, eight, etc.) or less (e.g., three) blades. The blades may be tapered such that they are thicker at the larger end 40 to provide a larger surface area for placing of the ball onto the tee 30.

Those skilled in the art will also understand that the above exemplary tees 10-30 are only three possible designs for tees according to the present invention. The present invention is not limited by any particular design or shape of the tees. The shape of the tee may vary according to the type of insertion device that is created to insert the tee into the ground. The tee may have any shape at the top that is suited for holding the ball, as long as the shape does not confer any mechanical advantage to the golfer. The only limiting factor is that the tee design should meet any design requirements or rules of the USGA (United States Golf Association) or any other regulatory body for golf. For example, according to the USGA regulations, the standard tee size is up to 4 inches in its longest dimension. In another example, while the tee can be any shape, the shape cannot confer any advantage based on its orientation. That is, the tee will function in the exact same manner regardless of the orientation of the inserted tee, e.g., the exemplary tee 10 will perform in the exact same manner when it is placed in any orientation around the entire 360 degree circumference of the fluted end 4.

In one exemplary embodiment, the biodegradable material may be honeycombed so as to prevent collapse. In another exemplary embodiment, the biodegradable material may be corrugated or the wall thickness adjusted for depth insertion, rigidity, and strength. In another exemplary embodiment the tee may be laminated, or similarly treated, so as to increase the resistance to bending on insertion, and to support the golf ball at its standard weight. In another exemplary embodiment, the golf tee may include a solid portion (or be completely solid). In another exemplary embodiment, the tee may have multiple parts. For example, a first part that is inserted into the ground is designed to be biodegradable in the ground, while a second part that remains above ground and holds the ball may be designed to be disposable or recyclable.

It should also be noted that the tee may have pleats such that when it is manufactured and packaged it is collapsed for easy packing and storage. However, when it is removed from the packaging for use and placed on the insertion device, the tee expands along the pleats to its full size. The expansion of the tee may be either manual by the golfer or the insertion device may expand the tee.

In another exemplary embodiment, a package of tees may include a series of variable length tees. That is, a set of nine tees may have tees having three different lengths (e.g., 1", 2" and 4", etc.). However as will be described in greater detail below, the insertion device may be used to insert a single tee length to any desired insertion depth. However, the insertion device may also work with the different length tees.

Figure 4:
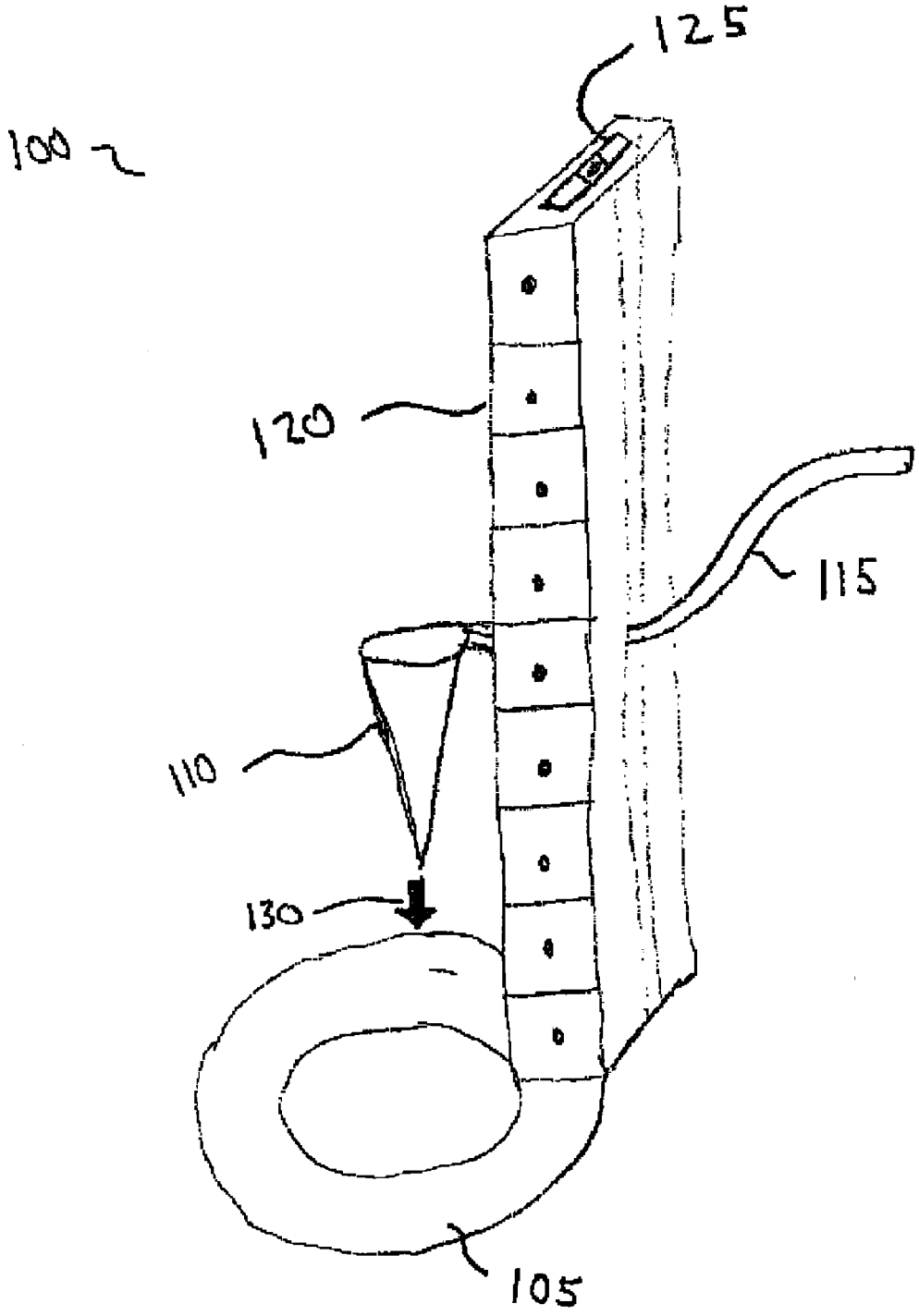
FIG. 4 shows an exemplary insertion device for a golf tee according to the present invention.

FIG. 4 shows an exemplary insertion device 100 for a golf tee according to the present invention. The insertion device 100 enables the individual player to insert the golf tee into the teeing ground to make a proper stroke on the tee ball. The insertion device 100 includes a base 105 having a generally circular shape with a circular cut-out in the middle. The bottom (not shown) of the base 105 is placed on the teeing surface (e.g., the ground of the tee box). The base 105 should be big enough that it supports the entire weight of the insertion device 100 without tipping over or becoming unbalanced when the insertion device 100 is operated.

The insertion device 100 also includes a mandrel 110 on which the tee will be placed for insertion. As shown in FIG. 4, when the insertion device 100 is activated, the mandrel 110 will move in the direction of arrow 130 to insert the tee in the ground through the circular cut-out of the base 105. In this example, the mandrel 110 is in the shape of an inverted cone such as the exemplary tee 10 described above. As shown, the golf tee 10 may be placed over the mandrel 110 for insertion into the ground. However, the mandrel 110 may take on different shapes based on the shape of the tee that is to be inserted. For example, if the exemplary tees 20 or 30 are to be inserted, the mandrel 110 may have four finger like structures that are used to grip the blades of the x-shape structure. Once the blades are gripped, the mandrel 110 may then move in the direction of arrow 130 to insert the tee. Thus, from the above description, it should be apparent that the mandrel 110 may take on any shape that is consistent with inserting the desired tee into the ground. It should also be noted that the mandrel 110 may be removable. That is, the mandrel 110 may, for example, be screwed onto the insertion device 100 so that it can be removed and replaced with a different shaped mandrel 110 based on the tee that the golfer prefers.

In the exemplary embodiment of FIG. 4, the insertion device 100 includes a handle 115 to hand activate the insertion device 100. The handle 115 may be pushed down (or pulled up depending on the gearing mechanism) to make the mandrel 110 move in the direction of arrow 130 for insertion of the tee into the ground. The insertion device 100 will include internal gearing that translates the movement of the handle 115 to the movement of the mandrel 110. The gearing creates a pressure/mechanical advantage so as to make tee insertion easier than a traditional tee and ball that is pushed in manually. In other exemplary embodiments, the insertion device 100 may be foot activated, or a combination of hand and foot activated. In addition, it is possible for the insertion device 100 to be battery operated. In such a case, a small motor is needed to drive the mandrel 110.

The insertion device 100 also includes a tower portion 120. The insertion device 100 is adjustable as to the depth of ground penetration and the height above the tee ground surface. The device enables an adjustable depth of penetration for each club in the bag ranging from a driver through a sand wedge or L wedge. The height of the tee is also adjusted for each club from being level with the ground to above a clubface height for a club which at its maximum face is determined by the USGA. As shown in FIG. 4, the tower 120 includes various markings for heights at which the tee (or insertion depth) can be set. Those skilled in the art will understand that the markings on the tower 120 are only exemplary and that other markings are also possible such as, markings related to insertion depth (e.g., 1", 2", etc.), markings related to tee height (e.g., 1", 2", etc.) markings related to club selection (e.g., driver, 3-wood, 5 iron, etc.), individual player markings, etc.

As described above, the insertion device 100 will include a gearing mechanism that allows the handle 115 and mandrel 110 to be moved along the tower 120 so that the specified insertion depth is achieved. In one exemplary embodiment, as the handle 115 is moved along the tower 120, a pin (not shown) may be inserted to hold the handle in the correct location. When the handle 115 is activated by the user, the gearing mechanism will translate the movement to the mandrel 110 to insert the tee into the ground. Those skilled in the art will understand that other manners of moving or securing the handle 115 at the different locations along the tower 120 may also be used. In addition, those skilled in the art will understand that any known gearing mechanism may be used to translate the movement of the handle 115 to the mandrel 110.

The tower 125 may also have an optional level 125 placed on the top of the tower 120 to indicate whether the ground on which the insertion device 100 has been placed is level. The level 125 may be, for example, a bubble level, a spirit level, etc. If the ground is not level, the user may move the insertion device 100 to level ground or the base 105 of the insertion device 100 may have levelers (not shown) that can be used to level the insertion device 100. The levelers may be, for example, adjustable feet that are on the bottom of the base 105.

The insertion device 100 is optimal, since it allows adjustments based on the type of club being used and the shot type, e.g., with or against the wind. The settings may be clearly delineated on the tower 120 that is keyed to a chart exemplifying the optimal settings, with options for varying club faces defined by club manufacturers. Mechanical depth gauge and height settings may be provided on easy to read scales. The mechanism may be attached to a golf bag, pull cart, riding cart, or otherwise similarly situated, so as to be portable or visible. The insertion device 100 facilitates a tee position that is in its longest length at a perpendicularity to the teeing ground surface, if so desired.

The device may be constructed of any rugged material such as, metal, plastic, synthetic, etc. The material may be based on the procedure and cost of manufacture, the sale price (e.g., wholesale or retail), the conditions of the tee box where it is going to be used, etc. For example, if a golf course is going to give the devices away for free so that golfers use the tees at their course or as a promotional item, the course may request a device that is made with the cheapest available materials that offer the desired durability. On the other hand, if the golf course is merely going to provide the device to golfers for a round of golf and then the golfers return the device or the course is going to leave the device at each of the tees on the course, the course may require a more rugged design with costlier materials (or possibly a more costly device) so that the device lasts a significant amount of time. Other factors that effect design may be the types of tee boxes at the courses that a player will play with the devices. For example, if a player is from the northern United States where the ground gets harder as the weather turns colder, the device may have to be more rugged than if the golfer is in a warmer climate where the ground remains relatively soft throughout the year. These and other factors known to those skilled in the art of golf course architecture and design may determine the material used to construct the device.

The exemplary embodiments of the present invention is a mechanical/electromechanical; pneumatic insertion device that allows the usage of proprietary tees that fit the device's insertion set up, or existing tees, if possible. There is a mechanical adapter that will accept other tees from other companies for set up and different depths for standard wood or plastic, as well as other synthetic tees on the market.

Production will be cost effective based on the materials and the method of fabrication. The rapid prototype may be the working model. It has modular construction for the replacement of working parts, and for the ease of repair and replacement by following simple directions. The insertion device 100 is easily cleaned since dirt or turf can be dislodged with a tool that is provided for the purpose of maintaining the functionality of the mechanism, or the device can be washed clean or compressed air cleaned. Activation may be hand or foot operated, or both.

The insertion device 100 may include a clip or other fastening mechanism so that it may be attached to a golf bag or a golf cart. In addition, a bag or other carrying case may be provided with the device so that it can be stored when not in use. As described above, the construction of the device will be modular. This may also allow for easy cleaning of the device by taking the device apart and rinsing it with water to clean out any dirt that accumulates during a round of golf. Moreover, because the device is made of rugged materials, it may be possible just to flush the water through the device (or dip the device into a bucket) for cleaning without taking the device apart.

There are several benefits to the golf tee and teeing device. The height of the tee may be adjusted based on a specific club being used by the player, based on the player preferences or based on the manufacturer's specification. For example, the device may include several stops that are set by the player (if it is their personal device). Thus, a player may set stops for different heights (or insertion depths) for a driver, for a three-wood, etc. Because different golf clubs have different characteristics, the height of the tee may be adjustable based on these different characteristics. This may be true for different club lengths (e.g., driver vs. 3-wood), different types of the same club (e.g., a first driver having a first face depth vs. a second driver having a second face depth) or different types of clubs (e.g., steel shaft, graphite shafts, fairway metals, hybrid clubs, etc.).

The tee and device also allow for perfect perpendicularity of the tee box with respect to the ground surface. The ease of insertion makes usage comfortable for golfers of all ages, ranging from junior players to players with conditions making insertion difficult such as older, arthritic players. There is no jamming and it is sold in packages of units per cart or individually. It allows for increased distance since there is minimal effective resistance at impact, and greater initial velocity and possibly reduced spin rates due to minimal if nearly no resistance to the club at impact, thereby allowing for increased club head velocity and possible longer distances associated with the increased club head velocity and the increased initial velocity of the ball. The tee may also provide reduced side spin due to reduced friction as a function of the reduced area of tee contact with the ball or collapsibility of the tee. In a normal tee, the ball sits in an excavated cup allowing for contact between the ball and the entire (or nearly entire) surface area of the excavated cup.

The device conforms to USGA specifications and regulations. The device does not confer an advantage in terms of the orientation of the tee itself. The disposable tees, pose no hazard to wildlife such as wild fowl, birds, mammals, or fish and will not damage (Golf Course Superintendent Association of America ("GCSAA") mowers or maintenance equipment. The tees allow for the aeration of the surface, and grass root structure of the tee ground. When activated, the mechanism itself presses down the turf around the site. The tees are preformed to be disposable so that one tee for each hole encourages a fresh tee up for each tee box. Each package contains enough tees to complete a round of golf and contains extras for re-teeing. If there is a need to re-tee due to a penalty, it is possible to purchase extra disposable tees.

It will be apparent to those skilled in the art that various modifications may be made in the present invention, without departing from the spirit or scope of the invention. Thus, it is intended that the present invention cover the modifications and variations of this invention provided they come within the scope of the appended claims and their equivalents.

What is claimed is:

1. A golf tee, comprising a body portion having a first end for inserting into the ground and a second end for supporting a golf ball when the first end is inserted in the ground, wherein the body portion is constructed of a biodegradable material, the body portion being shaped as an inverted cone when the first end is inserted into the ground, the second end having a substantially circular cross-section, the tee further comprising a plurality of structural portions, each structural portion having a third end and a fourth end, the structural portions intersecting the body portion and further intersecting other structural portions along a longitudinal axis of the inverted cone from the third end to the fourth end, the golf tee structural portions being configured to collapse when the tee is struck by a golf club.

2. The golf tee of claim 1, wherein the biodegradable material includes one of a corrugated material, a honeycombed material and a pleated material.

3. The golf tee of claim 1, wherein the plurality of structural portions are situated within a hollow space of the inverted cone shape, the structural portions being constructed of the biodegradable material.

4. The golf tee of claim 1, wherein the biodegradable material is a compressed cellulose material.

* * * * *